US005139533A

United States Patent [19]

Hildebrand

[11] Patent Number: 5,139,533

[45] Date of Patent: Aug. 18, 1992

[54] SUCCESSIVE DYEING WITH REACTIVE DYESTUFFS OF CELLULOSE FROM STANDING BATHS BY THE EXHAUST METHOD: USING EXHAUSTED DYE BATH WITH MADE UP VOLUME, SALT CONTENT AND PH

[75] Inventor: Dietrich Hildebrand, Odenthal, Fed. Rep. of Germany

[73] Assignee: Bayer Aktiengesellschaft, Leverkusen, Fed. Rep. of Germany

[21] Appl. No.: 691,273

[22] Filed: Apr. 25, 1991

[30] Foreign Application Priority Data

May 1, 1990 [DE] Fed. Rep. of Germany ..... 4013987

[51] Int. Cl.[5] ..... D06P 5/00; D06P 1/38; D06P 3/66

[52] U.S. Cl. ..... 8/502; 8/543; 8/549; 8/918

[58] Field of Search ..... 8/543, 549, 502

[56] References Cited

U.S. PATENT DOCUMENTS

| | | | |
|---|---|---|---|
| 3,627,474 | 12/1971 | Eckersley et al. | 8/641 |
| 4,152,113 | 5/1979 | Walker et al. | 8/502 |
| 4,292,039 | 9/1981 | Farris et al. | 8/502 |
| 4,715,863 | 12/1987 | Navratil et al. | 8/440 |

*Primary Examiner*—A. Lionel Clingman
*Attorney, Agent, or Firm*—Sprung Horn Kramer & Woods

[57] ABSTRACT

A process for the subsequent dyeing of cellulose fibre materials with reactive dyestuffs by the exhaust method from a single bath is characterized in that the exhausted bath used for the previous dyeing is reused without any further purification operation after the volume, salt content and initial pH value have each been brought to the level required for the next dyeing.

3 Claims, No Drawings

SUCCESSIVE DYEING WITH REACTIVE DYESTUFFS OF CELLULOSE FROM STANDING BATHS BY THE EXHAUST METHOD: USING EXHAUSTED DYE BATH WITH MADE UP VOLUME, SALT CONTENT AND PH

The present invention relates to a process for the salt-saving dyeing of cellulose fibre material with reactive dyestuffs from electrolyte-containing baths at 40° C. to 130° C. by the exhaust method.

The dyeing of cellulose fibre materials, such as cotton, viscose and linen is usually carried out, depending on the reactivity of the dyestuff used, from dyeing baths containing 5 to 120 g/l of common salt or sodium sulphate which, depending on the dyeing temperature, have a pH of 6 to 12 at 40° to 130° C.

With respect to the process procedure, a distinction can be made between two basic principles, in order to ensure that the dyeing operation gives a level, i.e. evenly dyed, textile material.

In one process, the salt necessary for the absorption of the dyestuff by the fibre material is added at the beginning of the dyeing process prior to the dyestuff and in the other process after addition of the dyestuff. Addition of the salt before the addition of the dyestuff is preferred for technical reasons, due to the simpler handling. Starting the dyeing process with the liquor containing the salt is therefore a procedure which has been introduced in industry. The salt can be added to the dyeing liquor by using salt, i.e. addition of a highly concentrated salt solution or adding salt in solid form to the circulating liquor.

After the dyeing process is complete, the liquor containing the salt is discharged, and the dyed textile material is cleaned from non-fixed residual dyestuff by rinsing and washing. The salt content of the discharged residual liquor is, depending on the colour depth of the finished dyeing, 5 to 120 g/l.

The total salt consumption of the dyeing is, depending on the colour depth, 2.5 to 250 kg per 100 kg of dyed material.

Thus, the salt content of the residual reactive dyeing liquors constitutes not only an environmental pollution of the wastewater but also a significant proportion of the value of the costs of chemicals which on the whole have to be expended for producing the reactive dyeing.

A process for the dyeing of cellulose materials with reactive dyestuffs by the exhaust method from baths containing salt has now been found, which is characterised in that the exhausted bath used for the previous dyeing is reused without any further purification operation after the volume, salt content and initial pH value have each been brought to the level required for the next dyeing.

Reusing of an already used dyeing liquor thus enables an at least partial reusing of the amount of salt used for the previous dyeing.

The proportion of residual liquor remaining in the dyed material after the dyeing upon separation of the dyeing material from the residual liquor is removed by a repeated rinsing operation. Thus, the amounts of salt present in the proportion of residual liquor bound by the dyeing material are transferred to the rinsing liquor and are only of interest in special cases, due to their low concentration. However, portions of the rinsing liquors can also be collected and reused for a subsequent dyeing.

To reuse a dyeing liquor, the amounts of salt bound by the dyed material and discharged by the rinsing operation are replaced by adding fresh salt of the same type. Depending on the apparatus conditions, the amount of the proportion of residual liquor bound by the dyed material is 200–300%, relative to the amount of the textile material used. Accordingly, depending on colour depth, liquor length and retention power of the material, 1 to 200 kg of salt (common salt or sodium sulphate) can be saved per 100 kg of the textile material to be dyed by reusing the residual liquors of reactive dyestuffs.

The reuse of dyeing liquors is known in the textile industry by the term dyeing on standing baths and is used for the dyeing of various fibre materials. The dyeing of cellulose materials with reactive dyestuffs on standing baths has previously not been described. Quite the contrary; persons skilled in the art have been prejudiced against such a process, since they assumed that in the subsequent dyeing shifts in shade and losses in yield would occur. Surprisingly, this does not take place in the process according to the invention.

In a preferred embodiment, the dyeing time necessary for achieving the desired colour depth is prolonged by about 15–60 minutes and/or the dyeing temperature, after reaching the desired colour depth, is increased, for example by 10° C. to 20° C.

The dyeing is carried out in a known manner, for example by automatic control of the addition of alkali or the pH (cf. Le A 25 166). Advantageously, dyeing machines are used which have a conductivity measuring cell for automatic control and adjustment of a defined electrolyte content.

The dyeing machines advantageously contain an additional vessel for taking up the dyeing liquor mentioned.

Alkali metal hydroxides (LiOH, NaOH, KOH) are preferably used as fixing alkali. However, it is also possible to use, for example, sodium carbonate.

Using the process according to the invention, dyeings using the same or different dyestuffs can be carried out in succession.

Suitable reactive dyestuffs are any water-soluble reactive dyestuffs, for example those from the azo, anthraquinone, phthalocyanine, formazan or triphendioxazine series.

The process is preferably suitable for dyestuffs having a reactive substituent on a 5- or 6-membered aromatic-heterocyclic ring, for example a sym. triazinyl, pyrimidinyl or quinoxalinyl ring. Examples of reactive substituents are Cl, Br, F, ammonium, hydrazinium, pyridinium (containing substituents such as COOH, $CH_3$).

Furthermore, the process is also particularly suitable for dyestuffs having the grouping $—SO_2CH_2CH_2X$ ($X=Cl, OSO_3H$) or the grouping $—SO_2CH=CH_2$. The process is particularly suitable for dyestuffs having monochlorotriazinyl, monofluorotriazinyl, mononicotinyltriazinyl, 2,6-difluoro-5-chloropyrimidinyl or 5-chloro-6-fluoropyrimidinyl radicals.

EXAMPLE 1

100 parts of a bleached cotton material are treated in a dyeing machine for one hour with 2000 parts of a warm aqueous liquor at 50° C. which contains 2 parts of dyestuff I, 1 part of sodium bicarbonate, 12.6 parts of sodium hydroxide and 100 parts of sodium chloride in dissolved form.

The exhausted dyeing bath is then discharged into a storage tank. The retention power of the material is 300 parts of the liquor used. The discharged liquor contains 1700 parts of the original liquor. The dyeing machine is then filled twice with fresh water at 60° C. and the contents are discharged in each case after a treatment of 5 minutes. The discharged liquor is passed into the wastewater system.

The dyeing is then treated twice for 10 minutes each time with water at 80° C. The dyed liquors are discharged. This is followed by pouring in 1700 parts of fresh water, the bath is brought to the boil and treated at the boil for 10 minutes. The liquor is discharged, the dyeing is rinsed with fresh cold water and removed from the dyeing machine.

The dyeing machine is then entered with 100 parts of a bleached undyed cotton material. 60 parts of common salt in solid form are added to the residual liquor from the first dyeing which had been transferred to the storage tank and dissolved by means of a stirrer. The alkaline liquor is then brought to a pH of 6 by using dilute hydrochloric acid dissolved in 25 parts of water, the amount of acid required being determined in a preliminary test. The neutral, salt-containing liquor is then pumped back into the dyeing machine and heated to 50° C. After reaching this temperature, a warm solution at 50° C.

4 parts of dyestuff II in 150 parts of water is produced and metered in at a linear rate over a period of 45 minutes.

1 part of sodium bicarbonate is then dissolved in 25 parts of warm water at 50° C., the solution is added over a period of 15 minutes, and then 1.38 parts of sodium hydroxide are dissolved in 100 parts of warm water at 20° C. and metered in at a linear rate over a period of 60 minutes. After dyeing at 50° C. for 60 minutes, the exhausted dyeing bath is discharged into a storage tank. The dyeing machine is then filled twice with fresh water at 60° C. and the contents are discharged in each case after a treatment of 5 minutes. The discharged liquor is passed into the wastewater system.

The dyeing is then treated twice for 10 minutes each time with water at 80° C. The dyeing liquors are discharged. This is followed by pouring in 1700 parts of fresh water, the bath is brought to the boiling temperature and the dyeing treated at the boil for 10 minutes. The liquor is discharged, the dyeing is rinsed with fresh cold water and removed from the dyeing machine.

In the first dyeing process, a blue dyeing and in the second dyeing process a red dyeing is obtained which each have good fastness properties.

EXAMPLE 2

100 parts of a bleached cotton material are treated in a dyeing machine for one hour with 1000 parts of a warm aqueous liquor at 80° C. of pH 9.4 which contains 2 parts of dyestuff III, 2 parts of sodium bicarbonate, 4 parts of sodium carbonate and 80 parts of sodium chloride. The material is then treated at 95° C. for 10 minutes, and the liquor is pumped off and transferred to a batch tank having a volume corresponding to 100% of the dyeing volume of the dyeing machine. The pumped-off liquor consists of 700 parts of the original dyeing liquor.

The dyeing machine is then filled twice with fresh water at 60° C. and the contents are discharged in each case after 5 minutes; the discharged liquor is passed into the wastewater system. The dyeing is then treated twice for 10 minutes each time with water at 80° C. The liquors which are each dyed are discharged. This is followed by pouring in 700 parts of fresh water, heating the bath to the boiling temperature and treating the material at the boil for 15 minutes. The dyeing is then rinsed with cold water and removed from the dyeing machine. The dyeing machine is then entered with 100 parts of a suitable undyed cotton material. The residual liquor from the first dyeing which had been transferred to the batch tank is brought to a pH of 6 with 100 parts of an aqueous solution containing dilute hydrochloric acid, and 100 parts of an aqueous solution containing 20 parts of sodium chloride in dissolved form are then added, 2 parts of dyestuff III dissolved in 100 parts of water are then added, and the dyeing liquor obtained is transferred to the dyeing machine.

The liquor is heated to 80° C., and allowed to circulate in the presence of the material for 30 minutes.

100 parts of an aqueous solution containing 2 parts of sodium bicarbonate and 4 parts of sodium carbonate are then metered in evenly at a linear metering rate while maintaining vigorous liquor circulation.

The material is then dyed at this temperature for 1 hour and the residual liquor is then pumped off as in the first dyeing, and the dyeing is rinsed and aftertreated.

Instead of a total of 160 parts of common salt of the usual process which each time uses a new dyeing liquor, only 100 parts were required for the two dyeings. The process can be repeated as often as desired by additionally adding in each case the deficit of 20 parts of common salt and dyestuff and water.

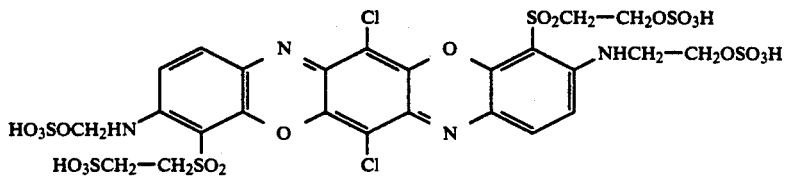

-continued (II)

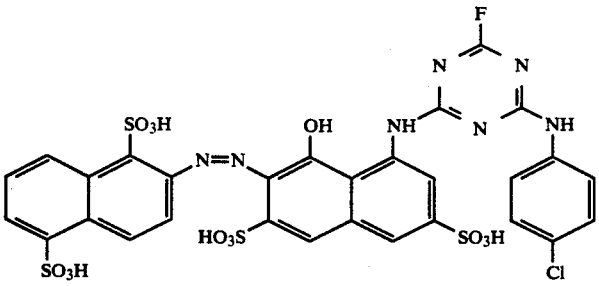

(III)

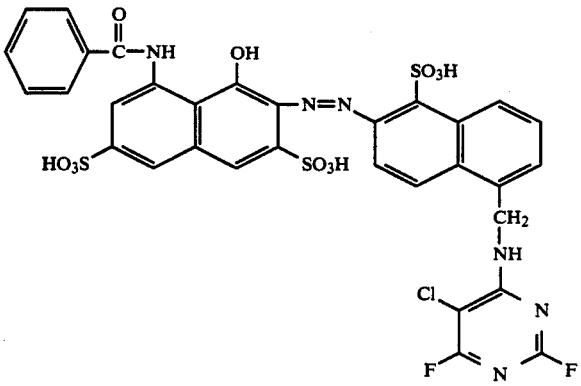

I claim:

1. A process comprising the following steps:

(a) dyeing cellulose fiber materials with reactive dyestuffs by the exhaust method from a single bath to yield dyed cellulose materials and an exhausted bath without any further purification;

(b) replenishing the exhausted bath from (a) so as to yield a replenished bath, said replenishing of the exhausted bath comprising adjusting the volume, salt content and pH values of the exhausted bath to volume, salt content and pH levels required for another dyeing; and (c) dyeing cellulose fiber materials with reactive dyestuffs by the exhaust method from the replenished bath from (b).

2. The process according to claim 1, wherein the dyeing of the cellulose fiber materials in (c) is carried out for 15–60 minutes longer and at 10°–20° C. higher than the dyeing of the cellulose fiber materials in (a).

3. The process according to claim 1, wherein the dyed cellulose materials from (a) are rinsed to yield rinsed dyed cellulose materials and rinsing liquors and then the rinsing liquors are added in (b) to the exhausted bath to adjust the volume, salt content and pH values of the exhausted bath to replenish the exhausted bath.

* * * * *